US009409739B2

(12) United States Patent
Dinnissen

(10) Patent No.: US 9,409,739 B2
(45) Date of Patent: Aug. 9, 2016

(54) SHEET ALIGNMENT MODULE AND POST-PROCESSING DEVICE COMPRISING SUCH SHEET ALIGNMENT MODULE

(71) Applicant: OCE-TECHNOLOGIES B.V., Venlo (NL)

(72) Inventor: Johannes H. A. Dinnissen, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/511,941

(22) Filed: Oct. 10, 2014

(65) Prior Publication Data

US 2015/0028539 A1 Jan. 29, 2015

Related U.S. Application Data

(63) Continuation of application No. PCT/EP2013/056819, filed on Mar. 29, 2013.

(30) Foreign Application Priority Data

Apr. 13, 2012 (EP) ..... 12164083

(51) Int. Cl.

| | |
|---|---|
| ***B65H 31/36*** | (2006.01) |
| ***B65H 31/40*** | (2006.01) |
| ***B65H 31/38*** | (2006.01) |
| ***B65H 33/08*** | (2006.01) |
| ***B42C 1/12*** | (2006.01) |
| ***B65H 31/20*** | (2006.01) |
| ***B65H 39/00*** | (2006.01) |

(52) U.S. Cl.

CPC *B65H 31/40* (2013.01); *B42C 1/12* (2013.01); *B65H 31/20* (2013.01); *B65H 31/38* (2013.01); *B65H 33/08* (2013.01); *B65H 39/00* (2013.01); *B65H 2301/4219* (2013.01); *B65H 2402/31* (2013.01); *B65H 2402/32* (2013.01); *B65H 2404/732* (2013.01); *B65H 2801/27* (2013.01)

(58) Field of Classification Search

CPC . B65H 31/38; B65H 33/08; B65H 2301/4219

See application file for complete search history.

(56) References Cited

U.S. PATENT DOCUMENTS

| | | | | |
|---|---|---|---|---|
| 6,832,759 | B2 * | 12/2004 | Nagasako et al. | 271/222 |
| 7,300,052 | B2 * | 11/2007 | Tamura et al. | 271/221 |
| 2011/0233858 | A1 | 9/2011 | Uchiyama et al. | |

FOREIGN PATENT DOCUMENTS

| | | | |
|---|---|---|---|
| EP | 1 918 233 | A1 | 5/2008 |
| JP | 2001-341927 | A | 12/2001 |
| JP | 2004-10239 | A | 1/2004 |

* cited by examiner

*Primary Examiner* — Howard Sanders

(74) *Attorney, Agent, or Firm* — Birch, Stewart, Kolasch & Birch, LLP

(57) ABSTRACT

Sheet alignment module and post-processing device comprising such sheet alignment module for aligning sheets in an operative orientation on a substantially horizontal sheet support member, comprising a support roller, the support roller being rotatably mounted on the sheet alignment module and configured to support the sheet alignment module during a sheet aligning movement, the sheet alignment module further comprising a jogger member comprising a substantially flat surface extending in a substantially vertical direction, the jogger member is moveably mounted on the sheet alignment module such that the jogger member is freely moveable in a substantially vertical direction with respect to the sheet alignment module.

14 Claims, 3 Drawing Sheets

SHEET ALIGNMENT MODULE AND POST-PROCESSING DEVICE COMPRISING SUCH SHEET ALIGNMENT MODULE

CROSS REFERENCE TO RELATED APPLICATIONS

This application is a Continuation of PCT International Application No. PCT/EP2013/056819 filed on Mar. 29, 2013, which claims priority under 35 U.S.C. §119(a) to patent application Ser. No. 12/164,083.3 filed in the European Patent Office on Apr. 13, 2012, all of which are hereby expressly incorporated by reference into the present application.

FIELD OF THE INVENTION

The present invention generally pertains to a sheet alignment module for aligning sheets in an operative orientation on a substantially horizontal sheet support member. The present invention further pertains to a post-processing device for stacking subsequently fed sheets of recording media, comprising such a sheet alignment module.

BACKGROUND ART

Sheet alignment modules for post-processing devices are known as sheet stack joggers. Commonly applied in oppositely placed pairs of joggers.

Commonly two elements are positioned at opposite sides of a stack of sheets and are actuated to knock at least the top of the stack to be able to align the last fed sheet to be aligned with the rest of the stack.

However, in order to produce staggered stacks, i.e. stacks which have subsets of sheets in stacks which have another orientation than the main stack, e.g. to identify separate jobs in a larger print operation, knocking the top portion of the stack may disorient the separate sub-stacks in a staggered collection. To be able to knock only the single top sheet without disturbing the rest of the stack may be cumbersome or requires a very precise mechanism of knockers.

SUMMARY OF THE INVENTION

In an aspect of the present invention, a sheet alignment module is provided. The sheet alignment module for aligning sheets in an operative orientation on a substantially horizontal sheet support member, comprising a support roller, the support roller being rotatably mounted on the sheet alignment module and configured to support the sheet alignment module during a sheet aligning movement, the sheet alignment module further comprising a jogger member comprising a substantially flat surface extending in a substantially vertical direction, the jogger member is moveably mounted on the sheet alignment module such that the jogger member is freely moveable in a substantially vertical direction with respect to the sheet alignment module.

The operative orientation is the orientation of the apparatus in which normal operation is intended. Thereby the substantially horizontal sheet support member is the orientation of the sheet support member, i.e. the collection member, which in operation is oriented substantially horizontal in normal operation. If the sheet support member comprises ridges and/or grooves, the substantially horizontal orientation is the orientation of the imaginary plane on which the sheets are collected on, when fed onto the sheet support member.

The support roller, which is rotatably mounted the body of the sheet alignment module is configured to support the sheet alignment module during a sheet alignment movement.

The roller rolls over the top of the existing stack or on top of the sheet support member, e.g. in case no stack has formed locally. The roller is oriented such that a movement in the direction of the sheet to be jogged is facilitated.

The sheet alignment module further comprises a jogger member. This jogger member is the member of the sheet alignment module which contacts the sheet or sheets to be jogged in normal operative orientation. The jogger member comprises a substantially flat surface such that the sheet or sheets to be jogged are aligned with respect to this surface during a jogging motion. The jogger member extends in a substantially vertical direction in operative orientation, i.e. the direction substantially orthogonal to the horizontally oriented sheet collection member.

The jogger member is moveably mounted on the sheet alignment module, such that the jogger member is freely moveable in a substantially vertical direction with respect to the sheet alignment module. This substantially flat surface can therefore scrape the top surface of the stack or sheet collection member under its own weight or assisted by an additional urging means. The range of the motion of the freely moveable jogger member is at least just under the bottom surface of the support roller, such that the jogger member can scrape just under the surface on which the support roller rolls in case nothing holds the jogger member back. In both directions the jogger member may be restrained at a minimum and maximum range of movement, such that the scraper element does not fall out of the grasp of the sheet alignment module.

The jogger member may be tuned to apply a scraping force on the top surface of the stack of sheet collection member, which is just enough to apply an alignment force and thereby urging a sheet to a required position and orientation, while not damaging the top surface of the sheet on which the scraping force is applied. It may be advantageous to tune the weight of the jogger element such that in a normal operative orientation, in a normal gravitational force field, the scraping force is tuned to both the scraping and the alignment operation.

In an embodiment the sheet alignment module, further comprises a bracket for retaining the jogger member such that the jogger member is freely moveable in a substantially vertical direction, and such that movements of the jogger member in other directions are constrained. This renders a simple construction to hold the jogger member while maintaining the freely moveable jogger member. In a further embodiment said bracket comprises substantially right-angled elements, grasping the jogger element with enough play to allow for a motional freedom of the jogger element.

In an embodiment, the jogger member has a first side comprising a substantially flat surface configured to contact a sheet during the sheet aligning movement and a sliding end configured to slide over the top of the surface on which the support roller supports the sheet alignment module. In a normal operative orientation, the bottom end of the jogger element scraps over the top surface of the stack or—in case no stack is locally available—over the top of the sheet collection member. The substantially flat surface at the first end directed to the sheet to be jogged and configured to contact the sheet during a jogging operation may in an embodiment comprise a coating, such as a soft rubber, to prevent damages to sheet edges during a jogging operation.

In a further embodiment, the sliding end has a slanted edge, directed away from the first side. This renders directionality in the scraping force of the sliding end of the jogger member. By slightly urging the jogger member onto the top surface of the stack, e.g. by means of its own weight, the jogger member will push a sheet to be jogged towards the desired alignment position if a sheet edge is encountered during a movement towards the alignment position in a jogging operation, while a sheet edge encountered when moving away from the alignment position, e.g. during the backward retraction of the jogger after a jogging operation, is guided under the sliding end of the jogger member by means of the slanted edge. Hereby not disturbing the position and orientation of that sheet.

In an embodiment the support roller is a barrel-shaped roller. This roller is a cylindrical roller which is at least partially rounded towards the ends of the roller, thereby forming a barrel shaped roller. By rounding the circumference of the roller, the stacks on which the roller rolls are less disturbed, as the contact area is smaller and better defined. In fact, where—under ideal conditions—a flat roller has a contact line, a barrel-shaped roller has a contact point with the top surface of a stack. This is less disturbing for the orientation thereof.

In a further embodiment the sliding end of the jogger member is shaped uniformly with respect to the contour of the support roller, i.e. the sliding edge of the jogger member is formed uniformly with the projection of the support roller. In case, the support roller is barrel-shaped, the sliding end is shaped like one edge of the barrel, if the support roller is spherically shaped, then the sliding edge is shaped like a half circle arc. This way the sliding edge does not limit the degrees of freedom of the support roller and vice versa.

In an embodiment the jogger member comprises a metal substrate on which a substantially flat contact layer is mounted, wherein said contact layer is configured to prevent substantial damage to a sheet of paper when the contact layer in operation abuts the sheet during an alignment operation. The metal substrate takes care for the rigidity of the jogger member while the contact layer is configured not to damage the sheets to be jogged.

In an embodiment the sheet alignment module further comprises an arm configured to connect the sheet alignment module to a controllably moveable jogging actuator. The arm may be configured to position the sheet alignment module in the desired position with respect to the stack of sheets.

In another aspect, the invention relates to a post-processing device for stacking subsequently fed sheets of recording media, comprising a substantially horizontal sheet support member for supporting a stack of subsequently fed sheets, further comprising feeding means for feeding sheets from a sheet supply to the sheet support member, wherein the post-processing device further comprises a controllably moveable jogging actuator and connected thereto a sheet alignment module according to the present invention.

In a further embodiment the post-processing device, further comprises a stapling station, said stapling station comprising a sheet collecting member for collecting sheets to be stapled and a sheet stack jogger, for aligning a stack of sheets to be stapled and a stapler unit, for stapling the collected stack of sheets.

Whereas stapling stations commonly comprise internal jogger means for jogging a set of sheets before stapling, the sheet alignment module can be attached to this internal jogger means downstream of the stapling station and be used for jogging the stack of sheets on the sheet support member. This renders a simple construction using already present jogger means of the stapling station to jog an externally formed stack of sheets.

In an embodiment the sheet alignment module is moveable in lateral direction such that the lateral alignment position is controllably configurable. Whereas the sheet alignment module is particularly suitable for aligning sheets in a plurality of lateral orientations (staggered stacks), it may be appreciated that the sheet alignment module in the post-processing device is laterally moveable to assume a plurality of lateral positions for jogging (sub-)sets of sheets to render a staggered stack of sheets, or single stacks of sheets in a controllable lateral position.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given herein below and the accompanying schematical drawings which are given by way of illustration only, and thus are not limitative of the present invention, and wherein.

DETAILED DESCRIPTION OF THE DRAWINGS

Figure 1A:
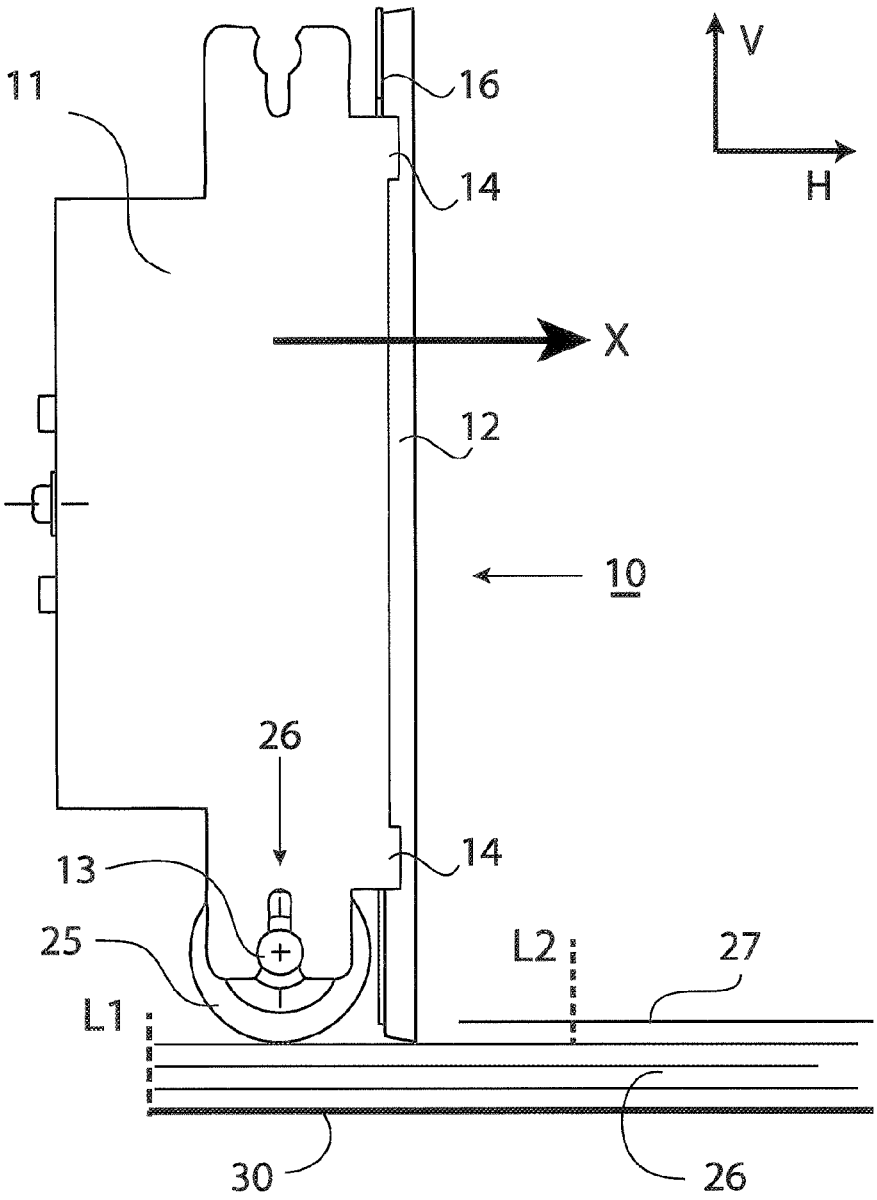
FIG. 1A shows a side view of an exemplary sheet alignment module.

The present invention will now be described with reference to the accompanying drawings, wherein the same reference numerals have been used to identify the same or similar elements throughout the several views.

FIG. 1A shows a side view of an exemplary sheet alignment module 10 for aligning sheets on a substantially horizontal (H) sheet support member 30. On top of the sheet support member 30 a stack of sheets 26 has been formed. This stack of sheets 26 is aligned along imaginary line L1. To form a staggered sub-stack on top of stack 26, a first sheet 27 of the sub-stack is to be aligned along line L2 while maintaining the alignment of stack 26. The sheet alignment module 10 comprises a main body 11 on which a barrel-shaped roller 25 has been rotatably mounted by means of axle 13 via a click connection facilitated by roller mount 26 formed on the main body 11.

The main body 11 further comprises a bracket 14 which consists of two right-angled grips configured to hold the jogger member 12 such that the jogger member 12 is able to freely move in vertical direction (V). The jogger member 12 comprises a metal substrate on which a rubber coating strip is applied for protecting jogged sheet edges.

The jogger member 12 has a sliding edge at the bottom which has a slanted edge, such that sheet edges are urged towards the alignment direction if it moves forward towards L2 in direction X, and such that a sheet easily slides under during the backward movement away from L2 such that the already formed stack 26 is not disturbed.

Figure 1B:
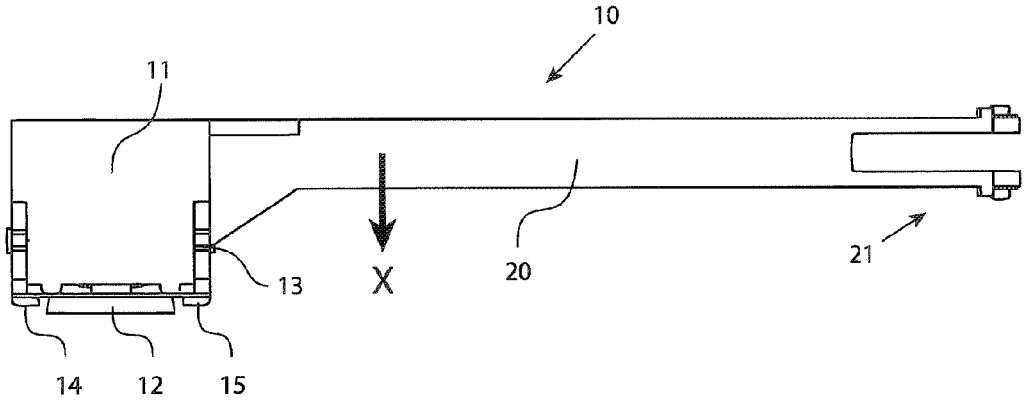
FIG. 1B shows a top view of an exemplary sheet alignment module.

FIG. 1B shows a top view of the exemplary sheet alignment module 10 as shown in FIG. 1A, further showing the opposite bracket portion 15 of bracket 14 and an arm 20 for connecting the sheet alignment module to a controllably moveable jogging actuator (not shown). The arm 20 is connectable to the controllably moveable jogging actuator by means of click connection 21, comprising elastic clamping means for receiving the related part of the jogging actuator.

Figure 1C:
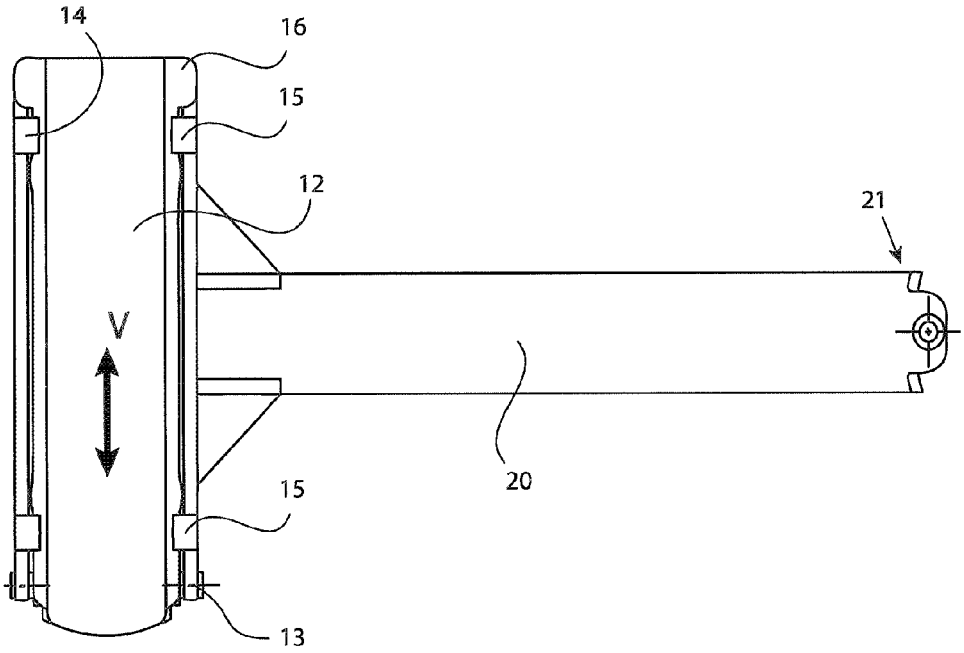
FIG. 1C shows a front view of an exemplary sheet alignment module.

FIG. 1C shows a front view of the exemplary sheet alignment module 10 as shown in FIGS. 1A and 1B, further showing limitation means 16 for limiting the vertical movement (indicated with arrow V) of the jogging member 12. The limitation means 16 comprise a bulged portion of the metal substrate which limits the vertical downward movement as it engages with the bracket 14, 15 to limit the sliding edge to move just beyond the circumference of the support roller 25 if not limited by any object. The sliding edge of jogging member 12 has been formed uniformly with the barrel-shaped roller to be able to follow the movement of the roller when in contact with the sheets to be jogged.

Figure 2:
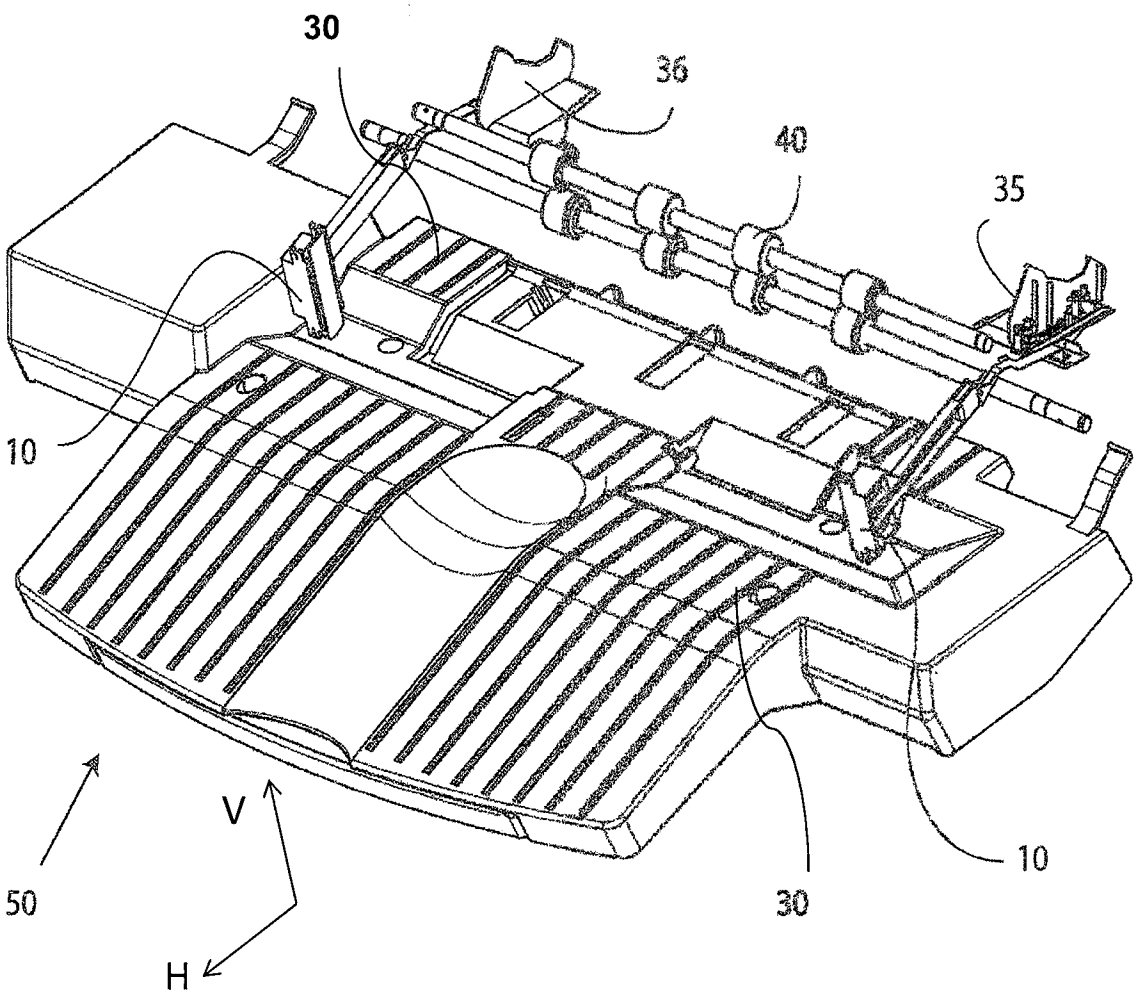
FIG. 2 schematically illustrates an embodiment of a post-processing device comprising a sheet alignment module according to the present invention.

FIG. 2 schematically illustrates an embodiment of a post-processing device 50 comprising two sheet alignment modules 10 according to the present invention. The post-processing device 50 comprises feeding means 40 for feeding subsequent sheets onto sheet collection member 30. Although sheet collection member 30 comprises several grooves and ridges, the sheet collection member 30 is horizontally oriented as the imaginary plane on which a sheet is supported is substantially horizontal in normal operative orientation. The post-processing device 50 further comprises a stapling station having a moveable stapler (not shown) and internal stapling joggers 35, 36 for aligning a subset of sheets before a stapling action. The sheet alignment module is fixedly mounted on an arm which connects the sheet alignment module to the jogging members 35, 36 of the stapling station. By actuating the stapling joggers 35, 36 the sheet alignment module is also actuated and thereby jogs a sheet or stack of sheets forming on sheet collection member 30.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A sheet alignment module assembly for aligning sheets in an operative orientation on a substantially horizontal sheet support member, the sheet alignment module comprising:

a substantially horizontal sheet support member for supporting a stack of subsequently fed sheets, and a sheet alignment module, the sheet alignment module comprising:

a main body provided on or above the sheet support member, wherein the main body is moveable in a substantially horizontal direction with respect to the sheet support member for jogging sheets stacked on the sheet support member and moveable in a substantially vertical direction with respect to the sheet support member;

a jogger member comprising a substantially flat surface extending in a substantially vertical direction and moveably mounted on the main body, such that the jogger member is freely moveable in a substantially vertical direction with respect to the main body for allowing a bottom end of the jogger member to scrape over a top surface of the stack or sheet support member; and a support roller configured to roll in the substantially horizontal direction over the top of an existing stack or on top of the sheet support member, wherein the support roller is rotatably mounted on the main body and configured to support the sheet alignment module during a sheet aligning movement.

2. The sheet alignment module assembly according to claim 1, further comprising a bracket for retaining the jogger member such that the jogger member is freely moveable in the substantially vertical direction, and such that movements of the jogger member in other directions are constrained.

3. The sheet alignment module assembly according to claim 1, wherein the substantially flat surface is located on a first side of the jogger and is configured to contact a sheet during the sheet aligning movement and the bottom end is configured to slide over the top of a surface on which the support roller supports the sheet alignment module.

4. The sheet alignment module assembly according to claim 3, wherein the bottom end has a slanted edge, directed away from the first side.

5. The sheet alignment module assembly according to claim 3, wherein the sheet alignment module comprises limitation means for limiting the vertical movement of the jogger member such that the bottom end of the jogger member is moveable to a position beyond the circumference of the support roller.

6. The sheet alignment module assembly according to claim 1, wherein the support roller is a barrel-shaped roller.

7. The sheet alignment module assembly according to claim 6, wherein a sliding end of the jogger member is shaped uniformly with respect to the contour of the support roller.

8. The sheet alignment module assembly according to claim 1, further comprising an arm configured to connect the sheet alignment module to a controllably moveable jogging actuator.

9. A post-processing device for stacking subsequently fed sheets of recording media, comprising:

a sheet alignment module assembly according to claim 1; and feeding means for feeding sheets from a sheet supply to the sheet support member, wherein the post-processing device further comprises a controllably moveable jogging actuator connected to the sheet alignment module assembly.

10. The post-processing device according to claim 9, further comprising a stapling station, said stapling station comprising a sheet stack jogger for aligning a stack of sheets to be stapled.

11. The post-processing device according to claim 10, wherein the sheet alignment module is connected to the sheet stack jogger of the stapling station and wherein the sheet support member is positioned downstream of the stapling station.

12. The post-processing device according to claim 9, wherein the sheet alignment module is moveable in a lateral direction such that the lateral alignment position is controllably configurable.

13. The sheet alignment module assembly according to claim 1, further comprising an actuator connected to the main body for moving the sheet alignment module substantially horizontally and vertically with respect to the sheet support member.

14. A sheet alignment module for aligning sheets in an operative orientation on a substantially horizontal sheet support member, comprising:

a support roller, the support roller being rotatably mounted on the sheet alignment module and configured to support the sheet alignment module during a sheet aligning movement, the sheet alignment module further comprising a jogger member comprising a substantially flat surface extending in a substantially vertical direction, the jogger member is moveably mounted on the sheet alignment module such that the jogger member is freely moveable in a substantially vertical direction with respect to the sheet alignment module, wherein the support roller is configured to roll over the top of an existing stack or on top of the sheet support member, and wherein the jogger member comprises a metal substrate on which a substantially flat contact layer is mounted, wherein said contact layer is configured to prevent substantial damage to a sheet of paper when the contact layer in operation abuts the sheet during an alignment operation.

* * * * *